US011205400B1

(12) United States Patent
Jang

(10) Patent No.: US 11,205,400 B1
(45) Date of Patent: Dec. 21, 2021

(54) DISPLAY DEVICE FOR CONTROLLING LUMINANCE OF A DISPLAY PANEL AND METHOD OF OPERATING THE SAME

(71) Applicant: LG ELECTRONICS INC., Seoul (KR)

(72) Inventor: Eunkwang Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/066,336

(22) Filed: Oct. 8, 2020

(30) Foreign Application Priority Data

Sep. 14, 2020 (KR) ..... 10-2020-0117945

(51) Int. Cl.
*G09G 5/10* (2006.01)
*G09G 3/36* (2006.01)

(52) U.S. Cl.
CPC ..... *G09G 5/10* (2013.01); *G09G 3/36* (2013.01); *G09G 2320/0646* (2013.01)

(58) Field of Classification Search
CPC .... G09G 5/10; G09G 3/36; G09G 2320/0646; G09G 3/342; G09G 3/3618; G09G 2310/0237; G09G 2320/0626
See application file for complete search history.

(56) References Cited

U.S. PATENT DOCUMENTS 5,991,883 A * 11/1999 Atkinson ..... G06F 1/3203 713/300
8,217,884 B2 * 7/2012 Mizuno ..... G09G 5/006 345/99
9,036,084 B2 * 5/2015 Law ..... G09G 5/12 348/500
10,991,321 B1 * 4/2021 Chen ..... G09G 3/3618
2009/0079760 A1 * 3/2009 Tu ..... G09G 5/42 345/619
2013/0187937 A1 * 7/2013 Kerofsky ..... G09G 3/20 345/530
2016/0314738 A1 * 10/2016 Shiohara ..... H04N 5/23293
2017/0124934 A1 5/2017 Verbeure et al.
2018/0277034 A1 9/2018 Kim et al.
2019/0221186 A1 7/2019 Jang et al.
2020/0135146 A1 4/2020 Lee et al.

OTHER PUBLICATIONS

European Patent Office Application Serial No. 20210003.8, Search Report dated May 6, 2021, 11 pages.

* cited by examiner

*Primary Examiner* — Rodney Amadiz
(74) *Attorney, Agent, or Firm* — Lee, Hong, Degerman, Kang & Waimey

(57) ABSTRACT

A display device according to an embodiment of the present disclosure includes a display panel, a backlight unit configured to provide light to the display panel, an external input interface configured to receive an image frame from an external frame, and a processor configured to determine a scan rate of the image frame received through the external input interface, determine whether the determined scan rate is equal to a scan rate of a previous image frame, and control a dimming value of the backlight unit based on the determined scan rate of the image frame, when the determined scan rate is different from the scan rate of the previous image frame.

10 Claims, 4 Drawing Sheets

700

Vfrontvrr(max)

| Resolution | Vfreq. | Htotal | Vtotal | Fclk(MHz) | MVRR |
|---|---|---|---|---|---|
| 1920x1080p | 60 | 2200 | 1125 | 148.5 | 290 |
| | 120 | 2200 | 1125 | 297 | 1705 |
| 3840x2161p | 60 | 4400 | 2250 | 594 | 580 |
| | 120 | 4400 | 2250 | 1188 | 3409 |

DISPLAY DEVICE FOR CONTROLLING LUMINANCE OF A DISPLAY PANEL AND METHOD OF OPERATING THE SAME

CROSS-REFERENCE TO RELATED APPLICATIONS

Pursuant to 35 U.S.C. § 119(a), this application claims the benefit of earlier filing date and right of priority to Korean Patent Application No. 10-2020-0117945, filed on Sep. 14, 2020, the contents of which are all hereby incorporated by reference herein in its entirety.

BACKGROUND OF THE INVENTION

1. Field of the Invention

The present disclosure relates to a display device and a method of operating the same, and more particularly, to a display device for controlling luminance of a display panel and a method of operating the same.

2. Discussion of the Related Art

A display device for reproducing a game video may display more scenes during the same period of time than a display device operating at a scan rate of 60 Hz.

A user may feel a much smoother screen as the refresh rate is higher, and in a game that requires a fast reaction speed, a higher scan rate is required.

In addition, when the game video is played, a tearing phenomenon in which the screen is sheared horizontally may occur. The tearing phenomenon occurs when an image frame output by a graphic card and an image frame output by a display panel are not synchronized in a case where the scan rates of images are fixed.

In order to prevent the tearing phenomenon, there has proposed a variable scan rate (or variable refresh rate, VRR) technology that synchronizes the output frequency of the image frame of the graphic card with the scan rate of the display panel.

However, when a variable scan rate is applied, when an image signal with a low frequency is input, the charging and holding characteristics of pixel data deteriorate according to the storage capacitance size of the pixel electrode constituting the display panel, resulting in reduction in luminance.

As a result, a change in luminance occurs largely, which is noticeable in the form of flicker, thus interfering with the user's viewing.

In addition, a conventional liquid crystal display device controls the overall brightness of a screen through a pulse width modulation (PWM) signal, and controls backlight units with local dimming operation through serial peripheral interface (SPI) communication.

Since the frequency of an input image frame is random even when a luminance compensation algorithm is applied through PWM control, the frequency of the image frame cannot be predicted, and thus PWM generation and control for luminance compensation is delayed during several frames.

This causes a sudden change in luminance due to a delay in applying a luminance compensation value according to the frequency variable range of an input image frame, resulting in a phenomenon in which flickering becomes more severe.

SUMMARY OF THE INVENTION

An object of the present disclosure is to prevent flickering by reducing a change in luminance according to a change in an image frequency during a variable refresh rate (VRR) operation.

Another object of the present disclosure is to prevent flickering by reducing a change in luminance according to a change in an image frequency during a variable refresh rate (VRR) operation in an HDMI game mode.

A display device according to an embodiment of the present disclosure may determines a scan rate of the image frame received through the external input interface, determine whether the determined scan rate is equal to a scan rate of a previous image frame, and when the determined scan rate is different from the scan rate of the previous image frame, and control a dimming value of the backlight unit based on the determined scan rate of the image frame.

The display device may calculate a value of a vertical front porch constituting the image frame and determine a scan rate of the image frame using the calculated value of the vertical front porch.

The display device may further include a memory configured to store a table showing a correspondence relationship between a resolution, a maximum vertical front porch value and a scan rate, and the display device may determine a scan rate of the image frame matching the calculated value of the vertical front porch using the table.

The image frame may include information on the resolution, and the display device may determine a scan rate of the image frame matching the resolution and the maximum vertical front porch value greater than or equal to the calculated value of the vertical front porch.

According to the present disclosure, it is possible to minimize a change in luminance according to a change in a scan rate of an image frame when a variable refresh rate (VRR) operation is performed, thereby minimizing the occurrence of flickering.

According to the present disclosure, occurrence of flickering is suppressed when playing a game video, thereby enabling a user to watch a natural game video.

DETAILED DESCRIPTION OF THE PREFERRED EMBODIMENTS

Hereinafter, embodiments of the present disclosure will be described in more detail with reference to the drawings.

Figure 1:
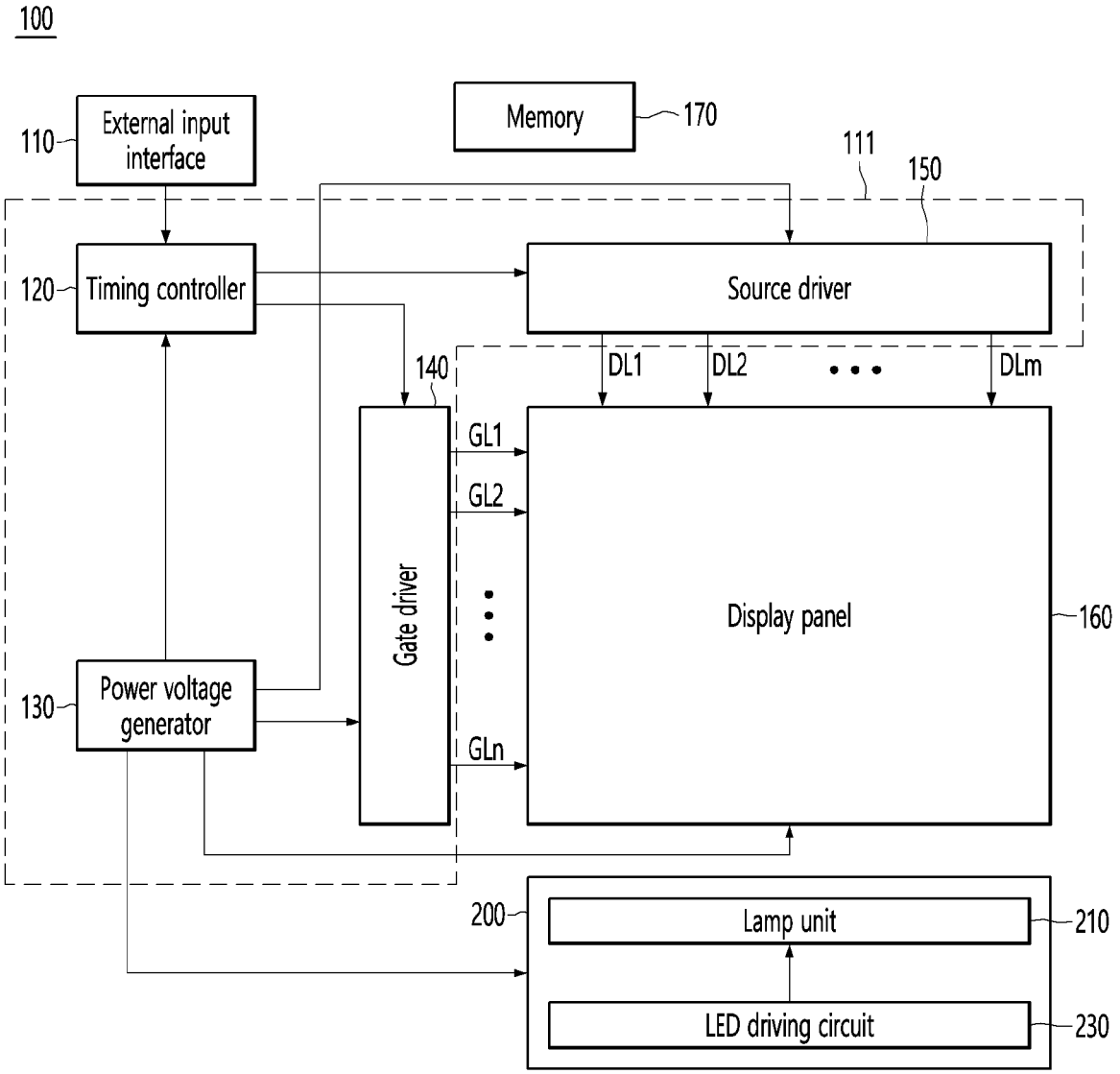
FIG. 1 is a block diagram for describing a configuration of a display device according to an embodiment of the present disclosure.

FIG. 1 is a diagram illustrating a display device according to an embodiment of the present disclosure.

The display device 100 of FIG. 1 may be any one of a monitor, a TV, a tablet PC, and a mobile terminal.

The display device 100 may include an external input interface 110, a processor 111, a display panel 160, and a backlight unit 200.

The external input interface 110 may receive image data from an external device.

The external input interface 110 may include one or more HDMI terminals and one or more A/V terminals.

The display panel 160 may be a liquid crystal display panel.

The display panel 160 may display an image based on an image signal input from the external input interface 110.

The display panel 160 may include a plurality of data lines DL1 to DLm and a plurality of gate lines GL1 to GLn which are intersected in a matrix form on a glass substrate, and a plurality of pixels corresponding to intersections.

Each of the plurality of pixels may output an image based on an image signal provided from a source driver 150, a driving signal provided to a gate driver 140, and light provided from the backlight unit 200.

The memory 170 may store programs and information necessary for driving the display panel 160.

The backlight unit 200 may provide light to the display panel 160.

The external input interface 110 may receive a control signal including one or more of image data (RGB Data), a clock signal, a horizontal synchronization signal, a vertical synchronization signal, and a data enable signal from an external device.

The horizontal synchronization signal may be a signal for performing synchronization in the horizontal direction of a screen.

The vertical synchronization signal may be a signal for performing synchronization in the vertical direction of the screen.

Also, the data enable signal may indicate a period of supplying data to a pixel.

The external input interface 110 may be included in the processor 111.

The processor 111 may include a timing controller 120, a power voltage generator 130, a gate driver 140, and a source driver 150.

The timing controller 120 may generate driving signals for driving the gate driver 140 including a plurality of driver integrated circuits and the source driver 150 including a plurality of driver integrated circuits, by using a control signal received from the external input interface 110.

For example, a driving signal for driving the gate driver 140 may include a high signal, a gate low signal, a clock signal, a start signal, a reset signal, and the like.

The power voltage generator 130 may supply a power voltage, a reference voltage, a ground voltage, and the like necessary for the operation of each component included in the processor 111.

The power voltage generator 130 may supply a common voltage corresponding to the reference voltage to the display panel 160.

The power voltage generator 130 may supply DC power (LED B+) required for driving the backlight unit 200.

The gate driver 140 may perform on/off control of each of the plurality of pixels included in the display panel 160, in response to a driving signal input from the timing controller 120.

The gate driver 140 may sequentially enable the gate lines GL1 to GLn on the display panel 160 for one horizontal synchronization time by outputting gate driving signals Vg1 to Vgn.

Accordingly, image signals supplied from the source driver 150 may be applied to each pixel.

The source driver 150 may apply an image signal to each pixel in response to a data signal and a driving signal input from the timing controller 120.

The backlight unit 200 may be arranged on one surface of the display panel 160 to provide light to the display panel 160.

The backlight unit 200 may include a lamp unit 210 and an LED driving circuit 230.

The lamp unit 210 may provide light to the display panel 160.

The lamp unit 210 may provide light to the display panel 160 such that the display panel 160 implements a high dynamic range (HDR) image under the control of the LED driving circuit 230.

For this, a local dimming method may be used. The local dimming may be a method of turning on or off a light in a specific area of the screen.

The local dimming may be used to implement an HDR image.

The lamp unit 210 may include a plurality of channels. Each of the channels may include one or more LED elements connected in series, a dimming circuit and a resistor.

Each LED element may emit red, green, or blue monochromatic light, or may emit white light.

The dimming circuit may be a semiconductor switch capable of turning on or off one or more LED elements.

The dimming circuit may be composed of field effect transistors (FETs).

The resistor may be used to measure a current flowing through one channel. A DC voltage supplied from the power voltage generator 130 to the lamp unit 210 may be dropped by passing through one or more LED elements, and the dropped voltage may be applied to the resistor.

By measuring a voltage across the resistor, a current flowing through the channel may be measured.

The plurality of channels may be connected in parallel and may be electrically connected to the LED driving circuit 230.

The LED driving circuit 230 may control the operation of the lamp unit 210.

The LED driving circuit 230 may include a plurality of LED drivers.

The number of LED drivers included in the LED driving circuit 230 may be less than the number of channels included in the lamp unit 210.

The number of LED drivers may be equal to the number of dimming circuits. That is, the number of dimming circuits may also be less than the number of channels.

Figure 2:
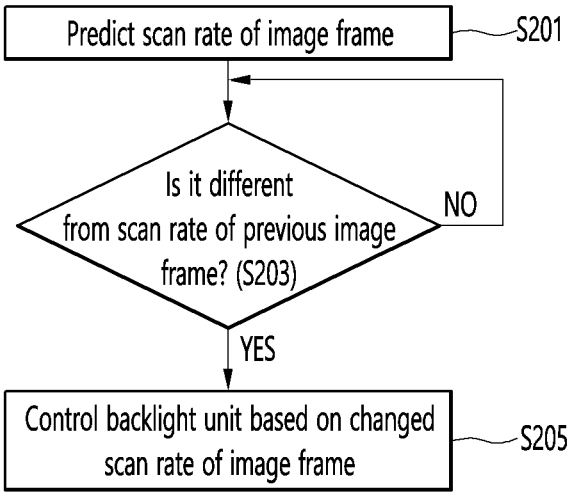
FIG. 2 is a flowchart for describing a method of controlling luminance of a display device according to an embodiment of the present disclosure.

FIG. 2 is a flowchart for describing a method for controlling luminance of a display device according to an embodiment of the present disclosure.

Hereinafter, a frequency may mean a scan rate of an image frame.

Referring to FIG. 2, the processor 111 of the display device 100 may predict a scan rate of an image frame (S201).

The external input interface 110 may receive an image signal or an image frame from a connected external device.

The external input interface may include one or more HDMI (High Definition Multimedia Interface) terminals or one or more A/V terminals.

An external device connected to the external input interface 110 may change a frequency and output an image frame. That is, the external input interface 110 may receive an image frame whose frequency varies over time.

The external device may transmit the image frame to the display device 100 after including information indicating that a variable scan rate is applied to the image frame in the image frame.

In an embodiment, the processor 111 may predict the scan rate of the image frame based on an image data packet received through the external input interface 110.

Details will be described with reference to FIG. 3.

Figure 3:
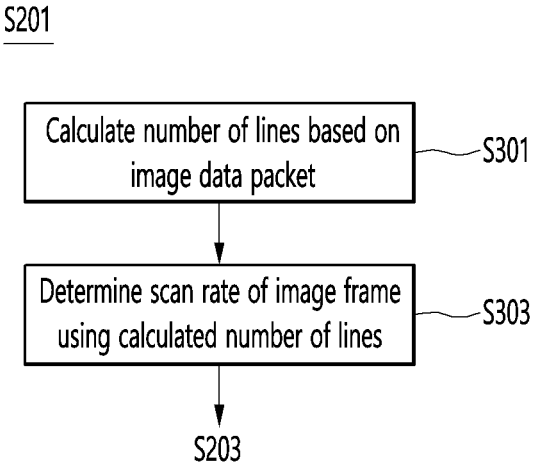
FIG. 3 is a flowchart for describing a method of predicting a scan rate of an image frame according to an embodiment of the present disclosure.

FIG. 3 is a flowchart for describing a method of predicting a scan rate of an image frame according to an embodiment of the present disclosure.

The processor 111 of the display device 100 may calculate the number of lines based on the image data packet received from the external input interface 110 (S301).

When a variable scan rate is applied, the image data packet may include information indicating a change in the scan rate.

Details will be described with reference to the drawings below.

Figure 4:
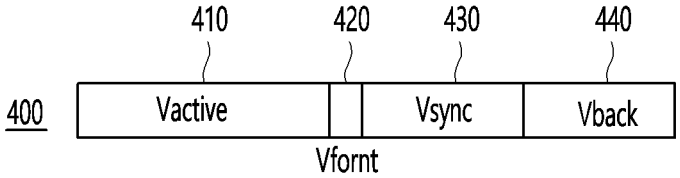
FIG. 4 is a diagram for describing the structure of an image data packet to which a variable scan rate is not applied.
Figure 5:
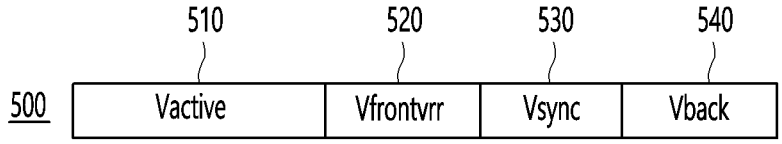
FIG. 5 is a diagram for describing the structure of an image data packet to which a variable scan rate is applied.
Figure 6:
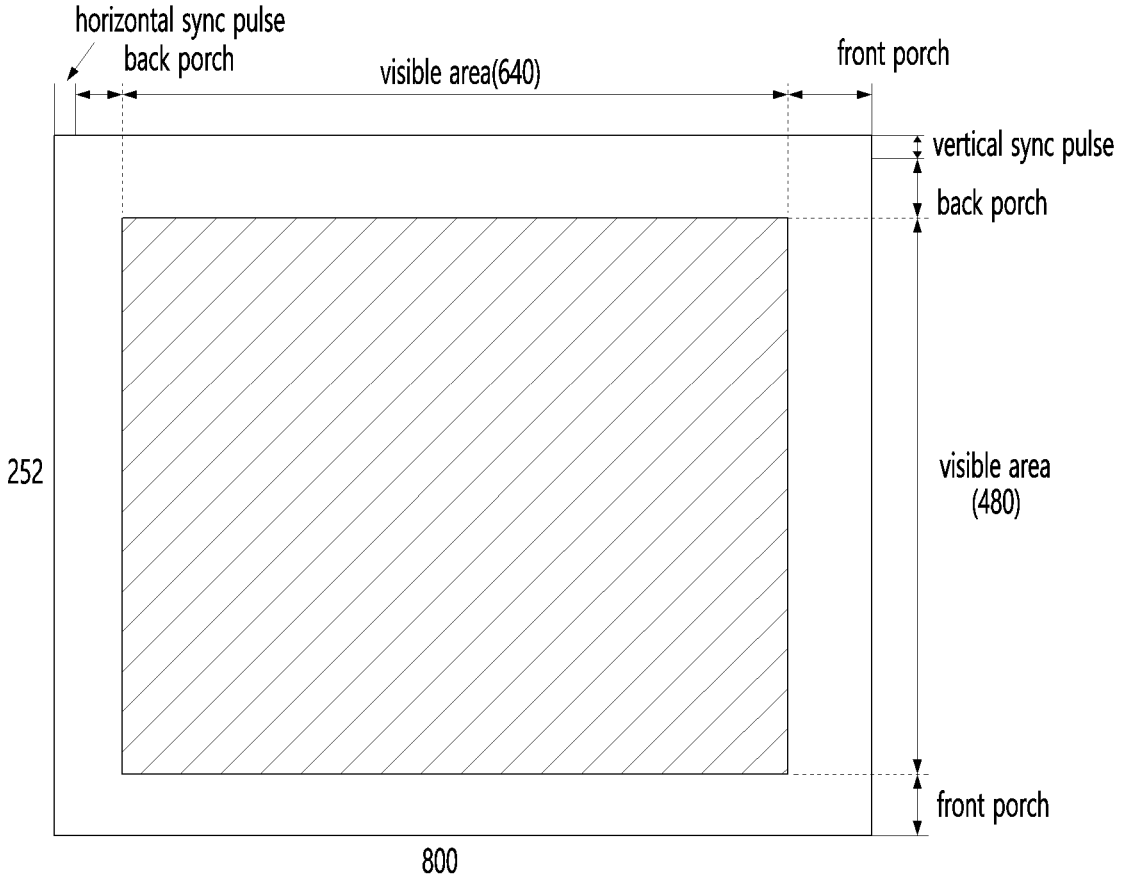
FIG. 6 is a diagram for describing the concept of a display panel having a resolution of 640×480.

FIG. 4 is a diagram for describing the structure of an image data packet to which a variable scan rate is not applied, FIG. 5 is a diagram for describing the structure of an image data packet to which a variable scan rate is applied, and FIG. 6 is a diagram for describing the concept of a display panel having a resolution of 640×480.

First, referring to FIG. 4, a first vertical image data packet 400 may include a vertical active porch 410, a vertical front porch 420, a vertical sync porch 430, and a vertical back porch 440.

The first image data packet 400 of FIG. 4 may have the structure of an image data packet to which a variable scan rate is not applied.

The vertical active porch 410 may be a section including data on an actual image to be displayed on a screen.

The front porch 420 may be a section indicating a waiting time after output of a vertical signal. The vertical signal may be a signal corresponding to the vertical active porch 410.

The vertical sync porch 430 may be a section for synchronizing vertical signals.

The vertical back porch 440 may be a section indicating a vertical signal output waiting time for which waiting is performed until the next vertical signal is output.

The sum of the vertical front porch 420, the vertical sync porch 430, and the vertical back porch 440 may be referred to as a vertical blank porch.

That is, the first image data packet 400 may be the sum of the vertical active porch and the vertical blank porch.

When the variable scan rate is not applied, the section of the vertical front porch 420 of the first image data packet 400 may be fixed.

Next, the structure of the second image data packet 500 to which the variable scan rate is applied will be described.

The second vertical image data packet 500 may include a vertical active porch 510, a vertical front porch 520, a vertical sync porch 530, and a vertical back porch 540.

The sum of the vertical front porch 520, the vertical sync porch 530, and the vertical back porch 540 may be referred to as a vertical blank porch.

That is, the first image data packet 500 may be the sum of the vertical active porch and the vertical blank porch.

The vertical active porch 510 may be a section including data on an actual image to be displayed on a screen.

The front porch 520 may be a section indicating a waiting time after output of a vertical signal. The vertical signal may be a signal corresponding to the vertical active porch 510.

The vertical sync porch 530 may be a section for synchronizing vertical signals.

The vertical back porch 540 may be a section indicating a vertical signal output waiting time for which waiting is performed until the next vertical signal is output.

Referring to FIG. 6, an area in which an actual image is displayed may correspond to 640×480, and an area to which a scan signal is applied may correspond to 800×525. An area where an actual image is not displayed may be a porch portion.

When a variable scan rate is applied, the section of the vertical front porch 520 of the second image data packet 500 may be changed. That is, the value of the vertical front porch 520 of the image data packet 500 input from the external input interface 110 may be changed in real time.

The value of the vertical front porch 520 may be the number of lines of the horizontal synchronization signal input onto the vertical front porch 520.

The processor 111 may determine the scan rate of the second image data packet 500 based on a change in the vertical front porch 520 of the second image data packet 500.

The processor 111 may count the value of the vertical front porch 520. To this end, the processor 111 may include a separate counter.

The processor 111 may calculate a value of the vertical front porch 520 and may determine a scan rate of an image frame based on the calculated number of lines.

The processor 111 may count the vertical front porch 520 and calculate a synchronization value based on the falling edge of the input horizontal synchronization signal and the vertical synchronization signal.

The processor 111 may determine the scan rate of the second image data packet 500 based on a change in the vertical blank porch of the second image data packet 500.

Since the vertical blank porch is the sum of the vertical front porch 520, the vertical sync porch 530, and the vertical back porch 540, the vertical blank porch may be changed according to a change in the vertical front porch 520 when the vertical sync porch 530 and the vertical back porch 540 are fixed.

The processor 111 may determine the scan rate of the second image data packet 500 using a value of the vertical blank porch of the second image data packet 500.

The processor 111 of the display device 100 may determine a scan rate of an image frame using the calculated number of lines (S303).

The processor 111 may determine a scan rate of an image frame based on a table showing a correspondence relationship between the number of lines and the scan rate of the vertical blank porch 520.

Details will be described with reference to FIG. 7.

Figures 7, 8:
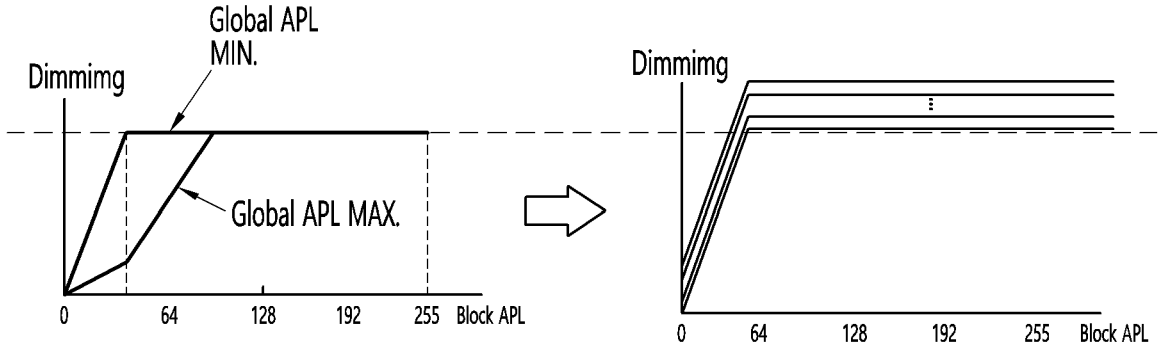
FIG. 7 is a diagram for describing a table showing a correspondence relationship between a resolution, the number of lines during a maximum vertical front porch duration, and a scan rate according to an embodiment of the present disclosure.
FIG. 8 is a graph for comparing dimming value control according to a conventional PWM method and dimming value control according to an embodiment of the present disclosure.

FIG. 7 is a diagram for describing a table showing a correspondence relationship between a resolution, the number of lines during a maximum vertical front porch duration, and a scan rate according to an embodiment of the present disclosure.

Referring to FIG. 7, a table 700 is shown, which shows a correspondence relationship between a resolution, a vertical frequency (corresponding to a scan rate), a horizontal total porch (Htotal), a vertical total porch (Vtotal), a clock frequency (Fclk), and a value of the maximum vertical front porch (number of lines).

The table 700 may be stored in a memory 170.

The table 700 may define a value of MVRR corresponding to a supported representative resolution.

The maximum vertical front porch MVRR may be a maximum value of the vertical front porch 520.

The value of the maximum vertical front porch MVRR may be calculated through Equation 1 below.

$$M_{Max}=\text{CEILING}(f_{PixelClock}/(H\text{total}\times VRR_{MIN}\times 0.994)-V\text{total}\times FVA_\text{Factor}) \quad \text{[Equation 1]}$$

The processor 111 may receive a resolution of an image frame from an external device through the external input interface 110.

The processor 111 may determine a scan rate of the image frame using a value (number of lines) of the vertical front porch 520 obtained in step S301 and the table 700.

When a resolution is 1920×1080, a scan signal may be scanned in an area of 2200×1125, and when a resolution is 3840×2160, a scan signal may be scanned in an area of 4400×2250.

The resolution may be information contained in a vertical back porch.

When the number of lines of the resolution vertical front porch 520 obtained from an external device is calculated, the processor 111 may search for a vertical frequency matching the calculated number of lines from the table 700.

For example, when the resolution is 1920×1080 and the number of lines of the vertical front porch is 290 or less, the processor 111 may determine the scan rate of an image frame to be 60 Hz.

In addition, when the resolution is 1920×1080 and the number of lines of the vertical front porch is 290 or less, the processor 111 may determine the scan rate of an image frame to be 120 Hz.

In addition, when the resolution is 3840×2160 and the number of lines of the vertical front porch is 580 or less, the processor 111 may determine the scan rate of the image frame to be 60 Hz.

In addition, when the resolution is 3840×2160 and the number of lines of the vertical front porch is 580 or less, the processor 111 may determine the scan rate of the image frame to be 120 Hz.

As described above, according to an embodiment of the present disclosure, it is possible to predict a scan rate of an image frame by calculating the number of lines of the vertical front porch.

A description will be given referring again to FIG. 2.

The processor 111 of the display device 100 may determine whether the predicted scan rate of the image frame is different from a scan rate of a previous image frame (S203).

The external device may change and output a frequency of the image frame in real time under a game mode.

In the case of a game image in which a fast screen switching is performed, a screen tearing phenomenon may occur. The tearing is a phenomenon in which multiple frames overlap each other in single scan because synchronization is not performed when a frame rate of a graphic card exceeds the scan rate of a display panel.

In order to prevent tearing, a variable scan rate (VRR) method which performs synchronization such that the scan rate of the display panel is synchronized with the change in a frame rate of a graphic card may be used.

Due to the variable scan rate method, a frequency of the image frame may be changed in real time.

The processor 111 may store a scan rate of an image frame, which is previously input, in the memory 170.

The processor 111 may determine whether the scan rate of the previously input image frame is equal to the predicted scan rate of the image frame.

The processor 111 of the display device 100 may control the backlight unit 200 based on the changed scan rate of the image frame when the predicted scan rate of the image frame is different from the scan rate of the previous image frame (S207).

The local dimming method may be a method for dividing a display screen of a liquid crystal display panel according to virtual blocks divided in a matrix form, deriving a representative value of input image data for each block, adjusting a dimming intensity (dimming value) for each block according to a representative value for each block and controlling a brightness of light sources of the backlight unit for each block.

The processor 111 may determine a dimming intensity of the backlight unit 200 corresponding to the changed scan rate of the image frame, and may control the backlight unit 200 to output light with the determined dimming intensity.

The dimming intensity may be the intensity of light output from each of the plurality of blocks constituting the backlight unit 200.

When the backline unit 200 includes a plurality of blocks, the dimming intensity of each block may be adjusted differently.

The backlight unit 200 may output light to have the dimming intensity determined according to a received control signal.

The processor 111 may transmit a driving signal for outputting a dimming value determined according to the frequency of the image frame to the LED driving circuit 230 of the backlight unit 200.

The LED driving circuit 230 may control the operation of the lamp unit 210 according to the received driving signal.

A backlight block value (a dimming value of the backlight block) may be calculated according to [Equation 2].

$$\text{Weighted sum(Backlight block value)}=(\text{Block value by previous } L/D)+(V\text{frontvrr}/(V\text{frontvrr}(\max\text{[illegible]})/BL(\max\text{[illegible]})-BL(\text{setting}))) \quad \text{[Equation 2]}$$

A block value according to an existing L/D may indicate a dimming value of a block during existing local dimming.

Vfrontvrr may be a calculated value of the vertical front porch 520.

Vfrontvrr(max) may be a value of the maximum vertical front porch corresponding to the resolution and Vfontvrr shown in the table 700 of FIG. 7.

BL(setting) may be a set dimming value of the backlight unit, and may be a settable value based on 8 bits (0 to 255).

BL(max) may be the maximum dimming value of the backlight unit, and may be expressed as a value of 255 based on 8 bits.

For example, in a state where the resolution is 1920×1080 and the scan rate of the image frame is 120 Hz, when the calculated value of Vfrontvrr is 1421 and the value of the BL (setting) is 95% (243), the backlight block value may be calculated according to [Equation 2].

It may be calculated as the backlight block value=243+(1421/(1705/(255−243)))=243+10=253. 253 may be expressed as 99.2% based on 8 bits.

Vfrontvrr(max) may be obtained through the table 700 shown in FIG. 7 by the resolution and calculated Vfrontvrr.

The backlight block value according to [Equation 2] may be a value to which luminance compensation is applied according to the calculated Vfrontvrr.

The backlight block value according to [Equation 2] may be an equation used to prevent an abrupt change in the luminance value.

A method of controlling a dimming value through conventional PWM and a method of controlling a dimming value of a block of the backlight unit 200 by Vfrontvrr, which is an embodiment of the present disclosure, are compared as follows.

The PWM control method is a method of controlling the overall brightness of a screen by adjusting a current supplied to the backlight unit 200 through a PWM signal. Since the PWM method is linked to the user interface screen, real-time control linked to an input image frame is impossible.

The luminance factor of the backlight unit according to the conventional PWM method is 90.25%, which is the product of the PWM setting value (95%) and the local dimming value (95%).

The luminance factor of the backlight unit according to an embodiment of the present disclosure is 94.05%, which is the product of the PWM setting value (95%) and the local dimming value (99.2%) calculated by [Equation 2].

That is, compared with the conventional PWM method, when the frequency of the image frame falls to a low frequency, the luminance may be better compensated.

Accordingly, even during the VRR operation, a sharp change in luminance is not made, thus preventing the flickering phenomenon.

Meanwhile, in the present disclosure, the local dimming value and the block value may be used as having the same meaning.

FIG. 8 is a graph for comparing dimming value control according to a conventional PWM method and dimming value control according to an embodiment of the present disclosure.

In FIG. 8, the left graph is a graph showing a change in a dimming value according to the conventional PWM method, and the right graph is a graph showing a process in which a dimming value is adjusted according to a value of a vertical front porch according to an embodiment of the present disclosure.

The horizontal axis of each of the left and right graphs represents the average picture level (APL) value of the block of the backlight unit, and the vertical axis represents the dimming value (dimming intensity).

In the case of the conventional PWM method, even when the scan rate of an image frame is changed, there is no change in the dimming value after a certain APL value.

However, according to an embodiment of the present disclosure, a dimming value may be adjusted according to the scan rate of the image frame.

When the dimming value is adjusted according to the scan rate of the image frame, a sudden change in luminance may be prevented. Accordingly, there is an effect that the flickering phenomenon is greatly prevented.

The present disclosure described above may be embodied as computer readable codes on a medium in which a program is recorded. The computer-readable medium includes all kinds of recording devices in which data readable by a computer system is stored. Examples of the computer readable medium may include a hard disk drive (HDD), a solid state disk (SSD), a silicon disk drive (SDD), a ROM, a RAM, a CD-ROM, a magnetic tape, a floppy disk, an optical data storage device, and the like. In addition, the computer may include a processor 170 of the display device 100.

What is claimed is:

1. A display device comprising:

a display panel;

a backlight unit configured to provide light to the display panel;

an external input interface configured to receive an image frame from an external device, wherein the image frame includes information on a resolution;

a memory configured to store a table showing a correspondence relationship between the resolution, a maximum vertical front porch value and a scan rate; and a processor configured to:

calculate a value of a vertical front porch constituting the image frame, determine, using the table, a scan rate of the image frame matching the resolution and the maximum vertical front porch value greater than or equal to the calculated value of the vertical front porch, determine whether the determined scan rate is equal to a scan rate of a previous image frame, and control a dimming value of the backlight unit based on the determined scan rate of the image frame when the determined scan rate is different from the scan rate of the previous image frame.

2. The display device of claim 1, wherein the image frame includes a vertical active porch and a vertical blank porch representing displayed image data, wherein the vertical blank porch includes a vertical front porch, a vertical sync porch and a vertical back porch, and wherein the processor is configured to determine the scan rate of the image frame using a value of the vertical blank porch.

3. The display device of claim 1, wherein the value of the vertical front porch is a number of lines of a horizontal synchronization signal input onto the vertical front porch.

4. The display device of claim 1, wherein the processor is configured to determine the dimming value based on the value of the vertical front porch, the maximum vertical front porch value, and the scan rate of the image frame.

5. The display device of claim 4, wherein the backlight unit includes:

a lamp unit including a plurality of blocks, each of the blocks including a plurality of LEDs, and a LED driving circuit configured to control driving of the lamp unit.

6. A method for operating a display device including a memory configured to store a table showing a correspondence relationship between a resolution, a maximum vertical front porch value and a scan rate, a display panel and a backlight unit configured to provide light to the display panel, the method comprising:

receiving an image frame from an external device, wherein the image frame includes information on the resolution;

calculating a value of a vertical front porch constituting the image frame;

determining, using the table, a scan rate of the image frame matching the resolution and the maximum vertical front porch value greater than or equal to the calculated value of the vertical front porch;

determining whether the determined scan rate is equal to a scan rate of a previous image frame; and controlling a dimming value of the backlight unit based on the determined scan rate of the image frame when the determined scan rate is different from the scan rate of the previous image frame.

7. The method of claim 6, wherein the image frame includes a vertical active porch and a vertical blank porch representing displayed image data, wherein the vertical blank porch includes a vertical front porch, a vertical sync porch and a vertical back porch, and wherein the determining of the scan rate includes determining the scan rate of the image frame using a value of the vertical blank porch.

8. The method of claim 6, wherein the value of the vertical front porch is a number of lines of a horizontal synchronization signal input onto the vertical front porch.

9. The method of claim 6, wherein the determining of the dimming value includes determining the dimming value based on the value of the vertical front porch, the maximum vertical front porch value, and the scan rate of the image frame.

10. The method of claim 9, wherein the backlight unit includes a lamp unit including a plurality of blocks, each of the blocks including a plurality of LEDs, and a LED driving circuit configured to control driving of the lamp unit.

* * * * *